US006416199B1

(12) United States Patent
Heine

(10) Patent No.: US 6,416,199 B1
(45) Date of Patent: Jul. 9, 2002

(54) MODIFIED UNDERWATER DIVING MASK

(76) Inventor: Simon Heine, P.O. Box 263, Majuro, MH (US) 96960

( * ) Notice: Subject to any disclaimer, the term of this patent is extended or adjusted under 35 U.S.C. 154(b) by 0 days.

(21) Appl. No.: 09/828,591

(22) Filed: Apr. 5, 2001

(51) Int. Cl.[7] ..... F21V 21/084
(52) U.S. Cl. ..... 362/105; 362/108; 351/43; 351/158
(58) Field of Search ..... 362/105, 108; 351/43, 158; 405/186

(56) References Cited

U.S. PATENT DOCUMENTS 5,660,460 A * 8/1997 McLeod, Jr. ..... 362/105
5,767,932 A * 6/1998 Gordon ..... 362/105
6,120,161 A * 9/2000 Van Der Bel ..... 362/105

* cited by examiner

*Primary Examiner*—Stephen Husar
*Assistant Examiner*—Guiyoung Lee

(57) ABSTRACT

A modified underwater diving mask assembly comprising a diving mask having a front piece with a pair of eye apertures, a lens and a strap. The front piece has a single recess formed on its exterior surface between the eye apertures and with a spotlight therein with at least a portion of the recess located between the apertures. A parabolic mirror is located within the recess with a light bulb and a lens thereover. A battery housing is included with a switch with a button and with at least one opening and a clip for securement to an item of apparel of the user. An electrical battery wire couples the light bulb and batteries and switch for turning the light on and off.

3 Claims, 3 Drawing Sheets

MODIFIED UNDERWATER DIVING MASK

BACKGROUND OF THE INVENTION

1. Field of the Invention

The present invention relates to a modified underwater diving mask and, more particularly, pertains to positioning a battery operated spotlight between the eye pieces of an underwater diving mask for improved visibility.

2. Description of the Prior Art

The use of diving masks of various designs and configurations are known in the prior art. More specifically, diving masks of various designs and configurations heretofore devised and utilized for the purpose of illuminating underwater areas through various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. Des. 325,106 to Sugita discloses a diving mask.

U.S. Pat. No. 4,254,451 to Cochran, Jr., discloses a sequential flashing device for personal ornamentation.

U.S. Pat. No. Des. 343,029 to Berenson discloses a dive mask.

U.S. Pat. No. 4,638,410 to Barker discloses a diving helmet.

Lastly, U.S. Pat. No. 5,224,772 to Fustos discloses an illuminated dive mask.

In this respect, the modified underwater diving mask according to the present invention substantially departs from the conventional concepts and designs of the prior art, and in so doing provides an apparatus primarily developed for the purpose of positioning a battery operated spotlight between the eye pieces of an underwater diving mask for improved visibility.

Therefore, it can be appreciated that there exists a continuing need for new and improved modified underwater diving mask which can be used for positioning a battery operated spotlight between the eye pieces of an underwater diving mask for improved visibility. In this regard, the present invention substantially fulfills this need.

SUMMARY OF THE INVENTION

In view of the foregoing disadvantages inherent in the known types of diving masks of various designs and configurations now present in the prior art, the present invention provides an improved modified underwater diving mask. As such, the general purpose of the present invention, which will be described subsequently in greater detail, is to provide a new and improved modified underwater diving mask apparatus and method which has all the advantages of the prior art and none of the disadvantages.

To attain this, the present invention essentially comprises a new and improved modified underwater diving mask assembly with a battery operated spotlight between the eye pieces of the mask comprising, in combination, a diving mask having a front piece formed of an elastomeric material with a pair of apertures therethrough positionable over the eyes of a wearer. A lens is located within each aperture and a strap is secured to the sides of the front piece for securing the front piece in position adjacent to the eyes of a wearer. The front piece has a recess formed on its exterior surface. A spotlight is located within the recess on the front piece with at least a portion of the recess located between the apertures. A parabolic mirror is located within the recess with a light bulb located within the parabolic mirror and a lens secured within the annular recess adjacent to the front surface of the front piece sealing the bulb and mirror from water. A battery housing is formed in a generally rectilinear configuration and has side, top and bottom walls with an upper surface and a lower surface and at least one side wall. A clip is adapted to be in proximity to the side wall for securement of the housing to an item of apparel of the user. At least one of the side walls has a switch with a button and with a pair of openings and associated rotatable covers for opening in the top wall for the changing of batteries located within the housing. The housing also includes a resilient cover over the button for allowing the button to be depressed by a user while shielding the button from water. An electrical battery wire couples the light bulb and batteries and switch for turning the light on and off in response to the pressing of the button. The wire also includes at least two resilient C-shaped keeper loops secured to the front piece for the passage of the battery wire therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved modified underwater diving mask which has all the advantages of the prior art diving masks of various designs and configurations and none of the disadvantages.

It is another object of the present invention to provide a new and improved modified underwater diving mask which may be easily and efficiently manufactured and marketed.

It is a further object of the present invention to provide a new and improved modified underwater diving mask which is of a durable and reliable construction.

An even further object of the present invention is to provide a new and improved modified underwater diving mask which is susceptible of a low cost of manufacture with regard to both materials and labor, and which accordingly is then susceptible of low prices of sale to the consuming public, thereby making such diving masks of various designs and configurations economically available to the buying public.

Still yet another object of the present invention is to provide a new and improved modified underwater diving mask which provides in the apparatuses and methods of the prior art some of the advantages thereof, while simultaneously overcoming some of the disadvantages normally associated therewith.

Still another object of the present invention is to position a battery operated spotlight between the eye pieces of an underwater diving mask for improved visibility.

Lastly, it is an object of the present invention to provide a new and improved modified underwater diving mask assembly comprising a diving mask having front piece formed of an elastomeric material with a pair of apertures therethrough positionable over the eyes of a wearer. A lens is located within each aperture and a strap is secured to the sides of the front piece, The front piece has a recess formed on its exterior surface. A spotlight is located within the recess on the front piece with at least a portion of the recess located between the apertures. A parabolic mirror is located within the recess with a light bulb located within the parabolic mirror. A lens is secured within the annular recess adjacent to the front surface of the front piece. A battery housing is formed in a generally rectilinear configuration and has side, top and bottom walls with an upper surface and a lower surface and at least one side wall. A clip is adapted to be in proximity to the side wall for securement of the housing to an item of apparel of the user. At least one of the side walls has a switch with a button and with at least one opening and associated rotatable cover for opening in the top wall for the changing of batteries located within the housing. The housing also includes a resilient cover over the button. An electrical battery wire couples the light bulb and batteries and switch for turning the light on and off in response to the pressing of the button.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
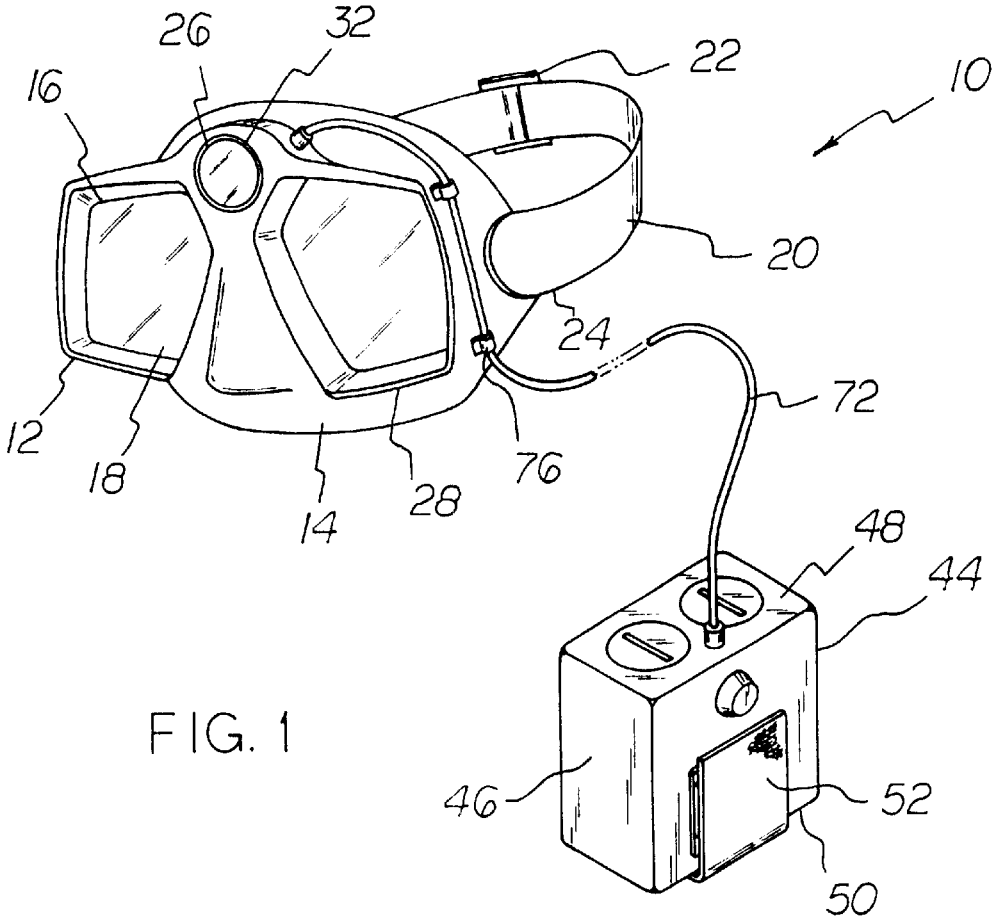
FIG. 1 is a perspective illustration of the preferred embodiment of the modified underwater diving mask constructed in accordance with the principles of the present invention.
Figure 2:
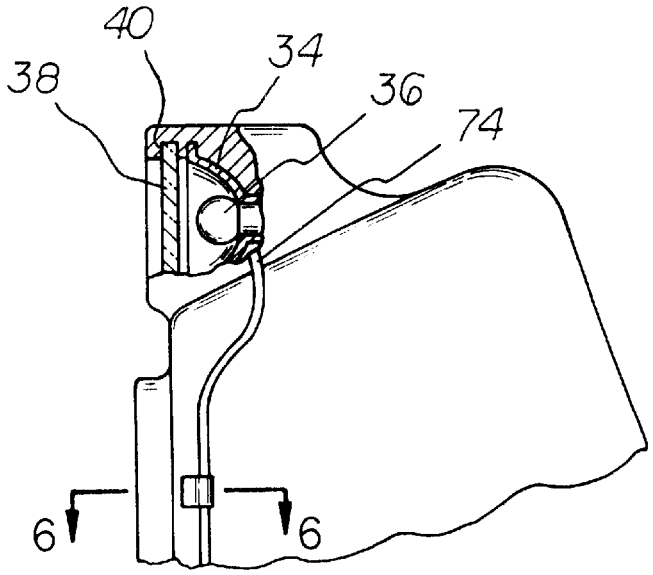
FIG. 2 is a side elevational view of the upper component of the mask shown in FIG. 1 with parts broken away to show certain internal constructions thereof.
Figure 3:
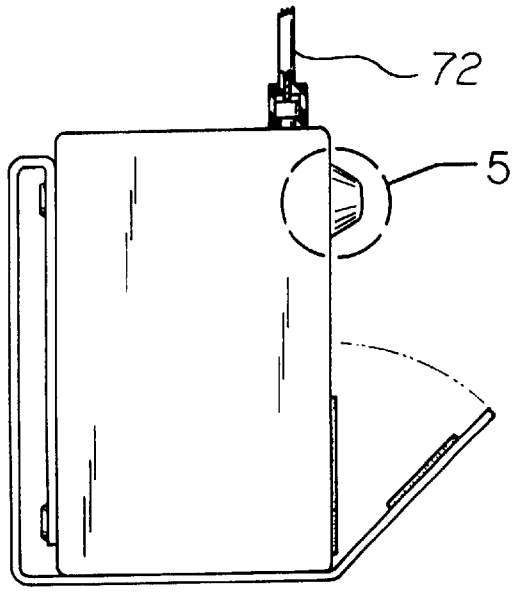
FIG. 3 is a side elevational view of the battery pack shown in FIG. 1.
Figure 4:
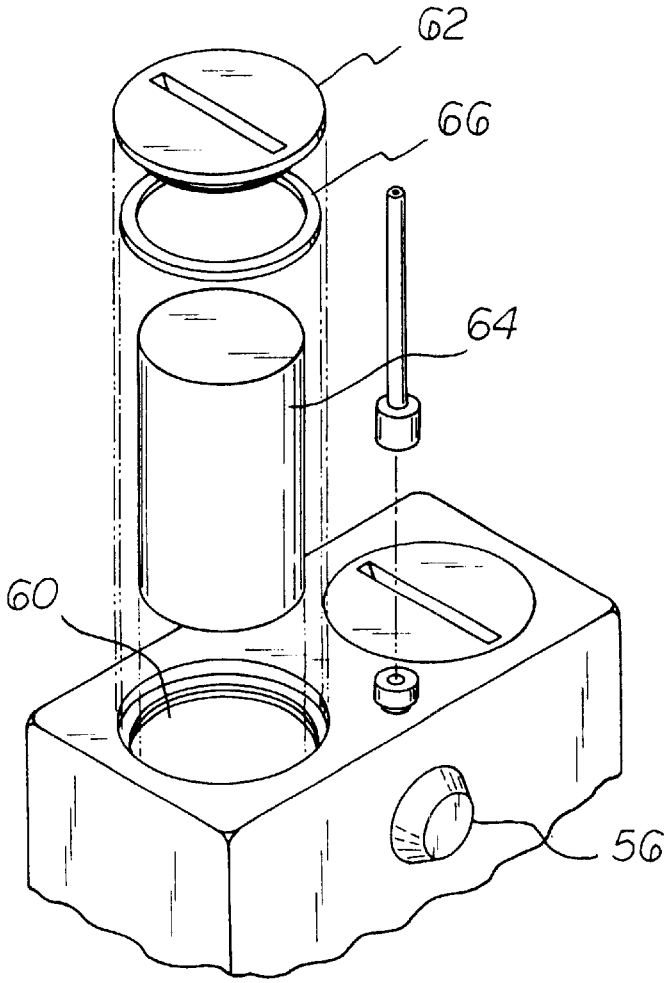
FIG. 4 is an exploded perspective view of a portion the battery pack shown in FIGS. 1 and 3.
Figure 5:
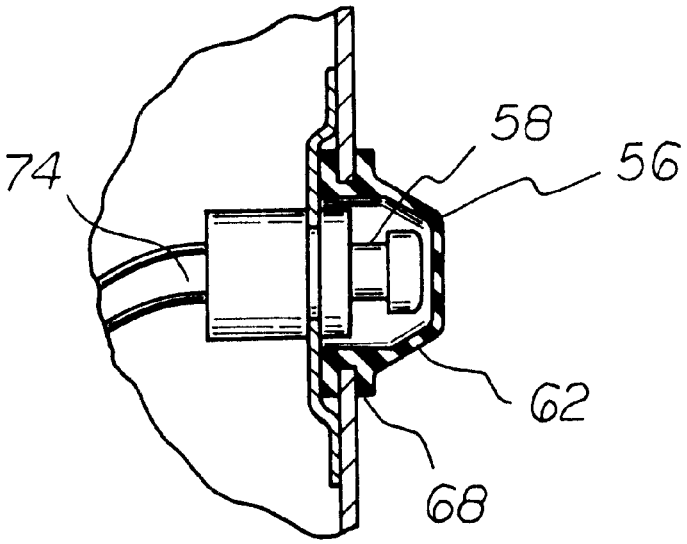
FIG. 5 is an enlarged cross sectional view taken at circle 5 of FIG. 3.
Figure 6:
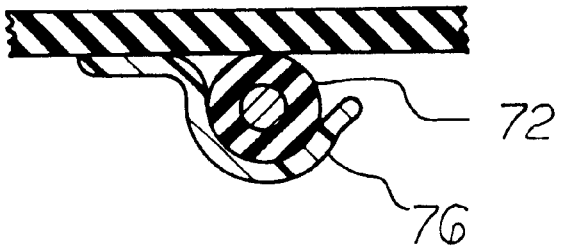
FIG. 6 is a cross sectional view taken along line 6—6 of FIG. 2.

With reference now to the drawings, and in particular to FIG. 1 thereof, a new and improved modified underwater diving mask embodying the principles and concepts of the present invention and generally designated by the reference numeral 10 will be described.

The present invention, the new and improved modified underwater diving mask, is comprised of a plurality of components. Such components in their broadest context include a diving mask, a spot light, a battery housing and a switch. Such components are individually configured and correlated with respect to each other so as to attain the desired objective.

More specifically, the present invention is a system 10 which has as its central component a diving mask 12. The diving mask has a front piece 14. The front piece is formed of an elastomeric material preferably rubber, natural or synthetic, or blends thereof. A pair of apertures 16 are formed through the front piece of the mask and are positionable over the eyes of a wearer. A lens 18 is located within each aperture to keep water out of the eyes of a wearer. In addition, a strap 20 of a resilient material and an adjustment buckle 22 has free ends 24 secured to the sides of the front piece. The strap is for securing the front piece in position on the face of a wear adjacent to the wearer's eyes. In addition, the front piece also has a recess 26 formed in its exterior surface. Furthermore, a groove 28 is formed in the front piece in each aperture.

A spotlight 32 is located within the recess on the front piece. At least a portion of the recess is located between the apertures. Located within the recess is a parabolic mirror 34. In addition, a light bulb 36 is located within the parabolic mirror. A lens 38 is secured within the annular recess with its periphery located within a groove 40 adjacent to the front surface of the front piece. This relationship allows for sealing the bulb and mirror from the water.

Next provided as a major component of the system 10 is a battery housing 44. Such housing is formed in a generally rectilinear configuration. The housing has side walls 46, a top wall 48 and a bottom wall 50. In addition, a clip 52 is formed in one of the side walls for securement of the housing to an item of apparel of the user.

One of the side walls is formed with a switch 56. Such switch has an external button 58. A pair of openings 60 are formed in the top wall of the housing. The openings have associated rotatable covers 62 threadedly received in the openings in the top wall. Such openings and covers are for changing batteries 64 located within the housing. A resilient O-ring 66 ensures a water-tight seal between the covers and the openings. Similarly, a resilient cover 68 is located over the button for allowing the button to be depressed by a user while shielding the button and its associated switch from water.

Lastly provided as a part of the system 10 is an electrical battery wire 72. Such wire has opposed ends 74 coupling the light bulb and the batteries and the switch. This arrangement allows for turning the light on and off in response to the pressing of the button. The wire also includes at least two resilient C-shaped keeper loops 76. Such keeper loops are secured to the front piece for the passage of battery wire therethrough to keep such wire out of the line of vision of a wearer.

The present invention is a modified underwater diving mask which features a battery operated spotlight between the eyepieces of the mask.

Similar in style to existing underwater diving masks, this modified design includes a small spotlight located between the two transparent eyepieces of the mask or above a single viewing window. Featured within the body of the spotlight is a small, replaceable bulb as well as a protective lens, similar to that of a flashlight. This device is powered by standard D-cell batteries which are carried within a compact small waterproof pouch or canister, along the waist belt of the diver. Also featured upon this battery storage unit is the operation switch which supplies power to the spotlight through the connecting, waterproof electrical cord. This lightweight, durable modification could be manufactured within any style diving mask.

Prior to diving, the user inserts the appropriate batteries inside the waterproof pouch or canister. The pouch is then attached to the diver's belt or waist area, ensuring that the electrical wires are safely connected to the mask. While underwater, the diver may then utilize the illumination of the spotlight by simply turning the switch to the on position. As needed, the batteries are easily removed and replaced.

This practical diving mask is especially useful for night fishing or swimming, enabling the diver's hands to remain free for additional equipment or movement.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A modified underwater diving mask assembly with a battery operated spotlight between the eye pieces of the mask comprising, in combination:

a diving mask having front piece having an exterior surface and formed of an elastomeric material with a pair of apertures therethrough positionable over the eyes of a wearer, a lens located within each aperture and a strap secured to the sides of the front piece for securing the front piece in position adjacent to the eyes of a wearer, the front piece having a single recess formed on its exterior surface;

a spotlight located within the recess on the front piece with at least a portion of the recess located between the apertures;

a parabolic mirror located within the recess with a light bulb located within the parabolic mirror and a lens secured within the annular recess essentially coplanar with the exterior surface of the front piece for sealing the bulb and mirror from the water;

a battery housing formed in a generally rectilinear configuration having side, top and bottom walls with an upper surface being in proximity to the side wall for securement of the housing to an item of apparel of the user, at least one of the sidewalls having a switch with a button and with a pair of openings and associated rotatable covers for opening in the top wall for the changing of batteries located within the housing, the housing also including a resilient cover over the button for allowing the button to be depressed by a user while shielding the button from water; and an electrical battery wire coupling the light bulb and batteries and switch for turning the light on and off in response to the pressing of the button, the wire also including at least two resilient C-shaped keeper loops secured to the front piece for the passage of the battery wire therethrough.

2. A modified underwater diving mask assembly comprising:

a diving mask having front piece formed of an elastomeric material with a pair of apertures therethrough positionable over the eyes of a wearer, a lens located within each aperture and a strap secured to the sides of the front piece, the front piece having a recess formed on its exterior surface;

a spotlight located within the recess on the front piece with at least a portion of the recess located between the apertures;

a parabolic mirror located within the recess with a light bulb located within the parabolic mirror and a lens secured within the annular recess adjacent to the front surface of the front piece;

a battery housing formed in a generally rectilinear configuration having side, top and bottom walls with an upper surface and a lower surface and at least one side wall, a clip adapted being in proximity to the side wall for securement of the housing to an item of apparel of the user, at least one of the side walls having a switch with a button and with at least one opening and associated rotatable cover for opening in the top wall for the changing of batteries located within the housing, the housing also including a resilient cover over the button; and an electrical battery wire coupling the light bulb and batteries and switch for turning the light on and off in response to the pressing of the button.

3. The device as set forth in claim 2 wherein the wire also include at least two resilient C-shaped keeper loops secured to the front piece for the passage of the battery wire therethrough.

* * * * *